US005165248A

United States Patent [19]

Sishtla

[11] Patent Number: 5,165,248

[45] Date of Patent: Nov. 24, 1992

[54] OIL RECLAIM IN A CENTRIFUGAL CHILLER SYSTEM

[75] Inventor: Vishnu Sishtla, E. Syracuse, N.Y.

[73] Assignee: Carrier Corporation, Syracuse, N.Y.

[21] Appl. No.: 753,588

[22] Filed: Sep. 3, 1991

[51] Int. Cl.[5] ..... F25B 43/02

[52] U.S. Cl. ..... 62/84; 62/193; 62/468

[58] Field of Search ..... 62/192, 193, 468, 84; 417/228; 184/6.16

[56] References Cited

U.S. PATENT DOCUMENTS 1,910,840 5/1933 Kagi ..... 62/193

4,187,695 2/1980 Schumacher ..... 62/192

*Primary Examiner*—John Sollecito

[57] ABSTRACT

The normal path for the flow of oil/refrigerant being reclaimed from the cooler is changed during periods of low load operation such that the oil/refrigerant mixture flows directly from the cooler to the ejector rather than by way of normal suction housing pass. This is accomplished by valve means responsive to either a pressure differential or the guide vanes position, either of which is indicative of the load condition.

10 Claims, 4 Drawing Sheets

OIL RECLAIM IN A CENTRIFUGAL CHILLER SYSTEM

BACKGROUND OF THE INVENTION

This invention relates generally to centrifugal chiller systems and, more particularly, to a method and apparatus for reclaiming oil from a cooler to the transmission of a centrifugal compressor.

In centrifugal compressors of the type which are used in large chiller type air conditioning systems, there is an inherent tendency for oil to migrate from the transmission to other parts of the system. In particular, during start-up and surge conditions, oil tends to migrate from the transmission into the motor, and hence to the evaporator or cooler. It was therefore necessary in such systems to provide the capability of reclaiming this lost oil and returning it to the transmission so as to allow continuous operation of the machine and to avoid degradation of the heat exchanger performance brought on by oil contamination.

The most common approach is to provide a stagnant cavity just downstream of the guide vanes in the compressor where oil may accumulate after being carried over with the main flow from the cooler. Some of the oil/refrigerant mixture may also be caused to flow directly from the cooler to the cavity because of the pressure difference between the two. An ejector, which is preferably driven by a source of gas from a compressor discharge, then functions to pump the oil from the cavity into the transmission of the compressor. This approach works fine for full load and part load operating conditions, but is unsatisfactory during operation in low load conditions. That is, when the guide vanes are closed down to accommodate low load operating conditions, the effectiveness of the ejector is substantially reduced. The reasons are twofold: first, the pressure at the compressor suction just downstream of the guide vanes is substantially reduced such that it is difficult to overcome the larger pressure difference between the low pressure cavity and the higher pressure transmission; and secondly, since the compressor discharge pressure is also reduced, the motive power of the ejector is substantially reduced. The result is that under low load operating conditions, the amount of oil that is pumped from the cavity into the transmission is substantially reduced, possibly to the point of inadequacy.

It is therefore an object of the present invention to provide an improved oil reclaim system.

Another object of the present invention is the provision for an oil reclaim system that functions properly at low load operating conditions.

Yet another object of the present invention is the provision for an oil reclaim system that operates irrespective of the load.

Still another object of the present invention is the provision for an oil reclaim system which is economical to manufacture and effective in use.

These objects and other features and advantages become more readily apparent upon reference to the following description when taken into conjunction with the appended drawings.

SUMMARY OF THE INVENTION

Briefly, in accordance with one aspect of the invention, valve means is provided to direct the flow of reclaimed oil along either of two channels, depending on whether the centrifugal compressor is operating under high or low load conditions. Under low load conditions, when the compressor discharge pressure is too low to provide an adequate flow of reclaimed oil from the suction housing, the reclaimed oil is made to flow directly from the cooler to the transmission of the compressor. Under higher load operating conditions, the valving is switched to provide for the flow of reclaimed oil to and from the suction housing.

In the drawings as hereinafter described, a preferred and modified embodiments are depicted; however, various other modifications and alternate constructions can be made thereto without departing from the true spirit and scope of the invention.

DESCRIPTION OF THE PREFERRED EMBODIMENT

Figure 1:
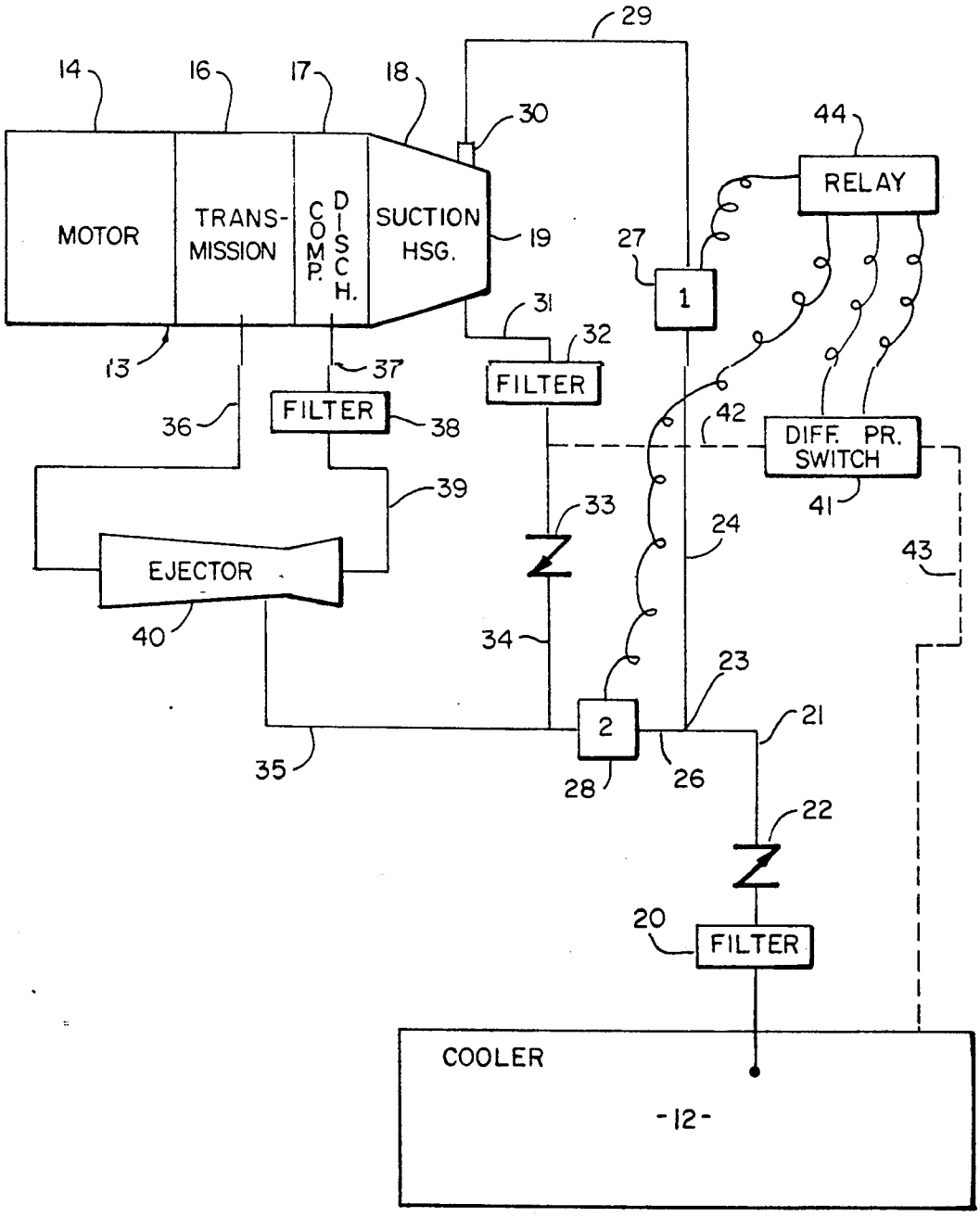
FIG. 1 is a schematic illustration of the oil reclaim system in accordance with one embodiment of the invention.

Referring now to FIG. 1 the invention is shown as being incorporated into a chiller type air conditioning system having a cooler 12, a condenser (not shown) and a centrifugal compressor 13. These components are installed in a conventional manner to form a part of a refrigeration circuit which includes an expansion device (not shown) for a introducing refrigerant vapor into the cooler 12, with the centrifugal compressor 13 then compressing the heated vapor coming from the cooler 12 before it passes on to the condenser.

The centrifugal compressor 13 is of a conventional type and includes a motor 14, a transmission 16, a compressor discharge section 17, and a suction housing 18. The motor 14 drives the compressor impeller through the transmission 16, with the impeller acting to compress the refrigerant passing into the suction housing 18 by way of an inlet 19, after which the compressed refrigerant passes into the compressor discharge section 17 to then flow to the condenser.

Figure 2:
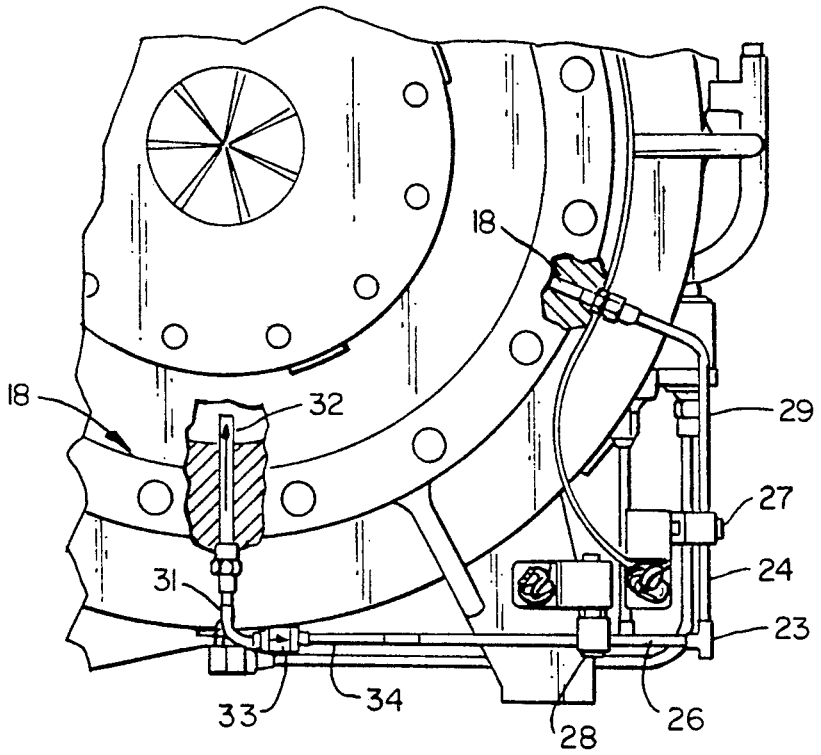
FIG. 2 is a partial front end view of a portion of the compressor with the present invention embodied therein.
Figure 3:
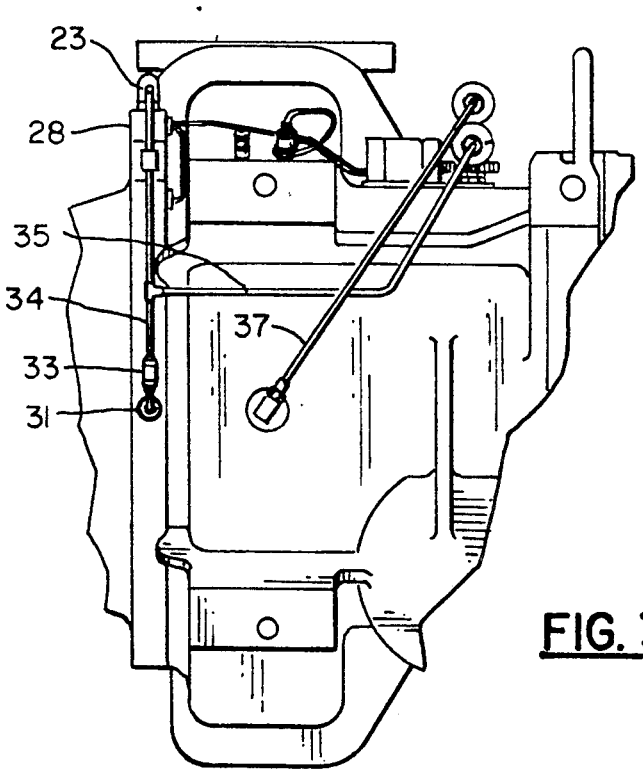
FIG. 3 is a bottom view thereof.

In order to reclaim the oil that has been transferred to the cooler 12, an oil/refrigerant mixture is drawn from the cooler 12, from a point just beneath the top of the cooler bundle, through a filter 20 and along the oil reclaim line 21. A check valve 22 is provided to ensure that there is no reverse flow into the cooler 12. As will be seen in FIGS. 1–3, a "T" connector 23 provides for the flow of oil/refrigerant in either of two lines, the primary line 24 or the secondary line 26, depending on whether the primary solenoid valve 27 or the secondary solenoid valve 28 is open. Those, in turn, will depend on the operating conditions of the centrifugal compressor 13 as will be described hereinafter.

Figure 4:
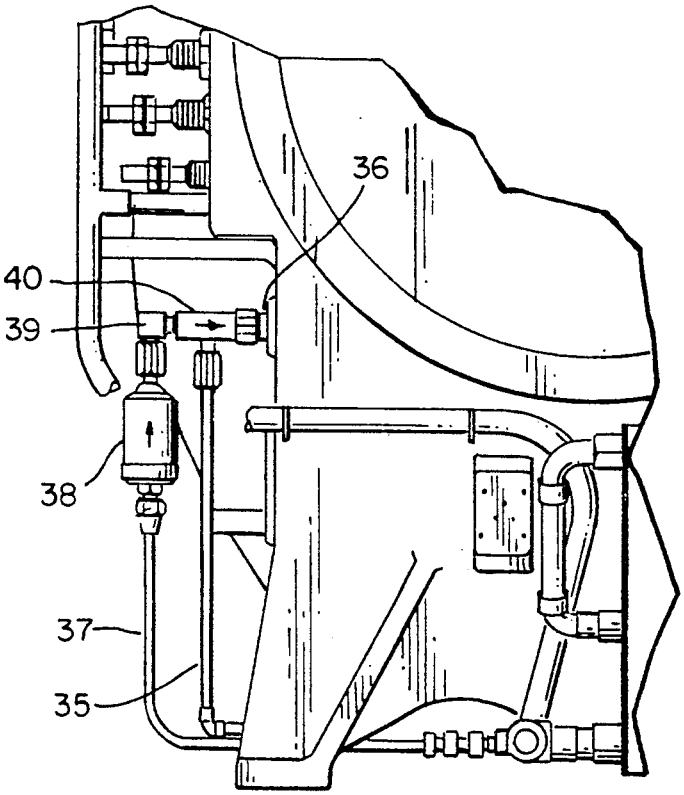
FIG. 4 is a rear end view thereof.

Under normal full load and part load operating conditions of the centrifugal compressor 13, the solenoid valve 27 will be open and the solenoid valve 28 will be closed. The oil refrigerant mixture then passes along the inlet line 29 to the suction housing 18. Fluid communication is then provided from the suction housing 18 by way of suction tube 31, a filter 32, a check valve 33, a line 34, (see also FIG. 4), a line 35, an ejector 40, and a ejector discharge line 36, to the transmission 16. The ejector 40 is driven by high pressure fluid from the compressor discharge section 17 passing along line 37, a filter 38, and a line 39 to the ejector 40. Thus, in normal operations, the ejector takes a suction on line 35, and hence to line 21, such that the oil/refrigerant mixture is drawn from the suction housing 18 and pumped into the transmission 16.

When operating under low load conditions, wherein the inlet guide vanes are closed down to the point where the compressor discharge pressure is reduced such that the normal flow as described hereinabove is not satisfactory, the position of the solenoid valves 27 and 28 are reversed such that solenoid valve 27 is closed and solenoid valve 28 is open. In such case, the oil/refrigerant mixture is pumped from the cooler 12, to the filter 20, the check valve 22, the oil reclaim line 21, the secondary line 26, the solenoid valve 28, the line 35, the ejector 40, the ejector discharge line 36, and finally to the transmission 16. During this operation, none of the mixture passes along line 29 and line 31 into the suction housing 18.

The operation of the solenoid valves 27 and 28 can be controlled by any of various means. A preferred approach as shown in FIG. 1 is the use of a differential pressure switch 41 which is connected by lines 42 and 43 to the suction housing 18 and the cooler 12, respectively. In normal operation, the pressure at the suction housing 18 and in the cooler 12 is close to being equal. As the load is reduced, however, the pressure in the suction housing 18 is reduced. Thus, when the pressure differential reaches a predetermined limit, the differential pressure switch 41 transmits a signal to the relay 44 to cause the relay 44 to close the solenoid valve 27 and open the solenoid valve 28.

Typical operating pressures for a system are 80 psia in the cooler and 79 psia in the suction housing 18 (i.e. downstream of the guide vanes), under full load conditions. The typical pressure differential required to switch to the alternative reclaim system would thus be 8 to 10 psia.

Figure 5:
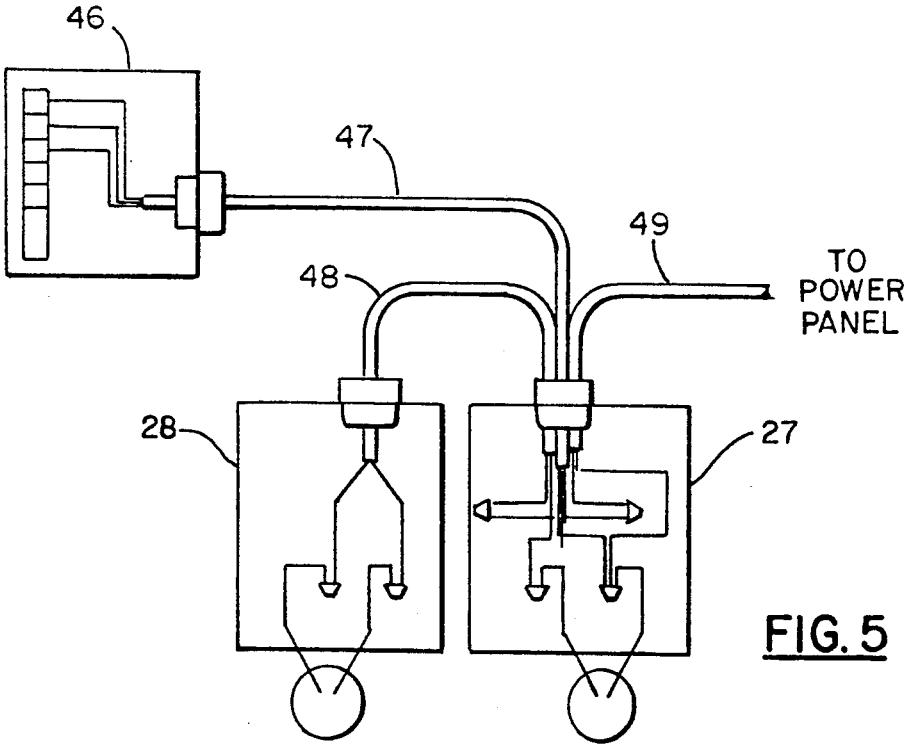
FIG. 5 is a schematic illustration of the sensor and valve portions thereof.

As an alternative to the pressure differential basis for switching between the values 27 and 28 for the oil reclaim system, the position of the guide vanes may be used for this purpose. As is shown on FIG. 5, the guide vane actuator 46, which is indicative of the actual position of the guide vanes, passes a representative signal along line 47 to the primary solenoid valve 27, and along line 48 to the secondary solenoid valve 28. Power is supplied to the circuit by way of the line 49 from the power panel. Thus, depending on the load, which in turn is dependent on the guide vane position, either the primary solenoid valve 27 is open to pass the reclaimed oil/refrigerant from the cooler to the suction housing 18 and the ejector 40, or the secondary solenoid valve 28 is open to pass the oil/refrigerant mixture directly from the cooler 12 to the ejector 40. Thus, the primary solenoid valve 27 will be open until the inlet guide vanes are moved to a predetermined threshold position (e.g. 30°) towards the closed position, whereupon a signal will be transmitted to cause the primary solenoid 27 to be closed and the secondary valve 28 to be opened. When the guide vanes are later opened beyond the threshold point the valve positions are reversed.

Figure 6:
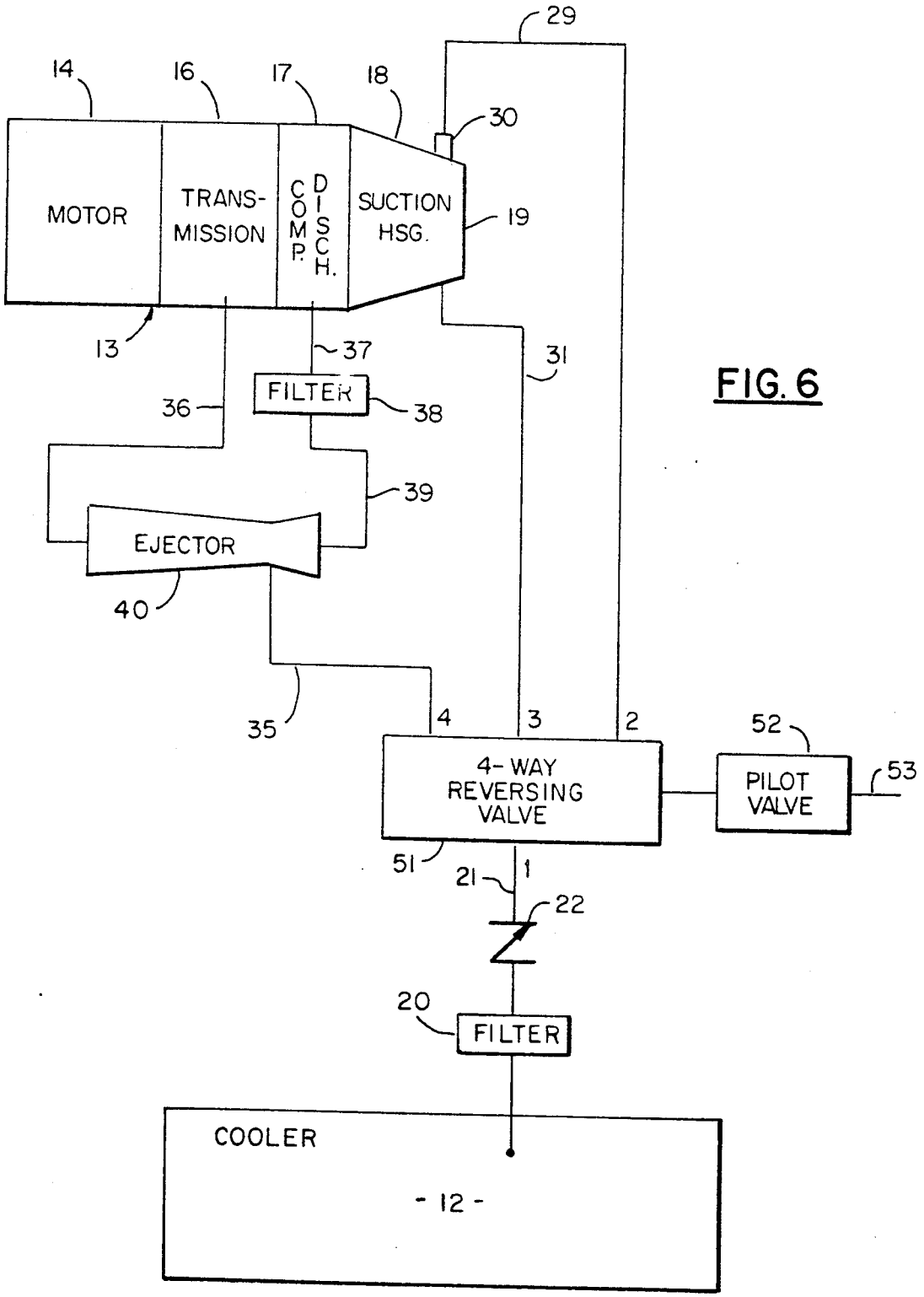
FIG. 6 is a schematic illustration of the oil reclaim system in accordance with another embodiment of the invention.

As an alternative to the changing of the oil/refrigerant flow path by way of solenoid valves and a relay, a single 4-way reversing valve as shown at 51 in FIG. 6 may be employed. Operation of the 4-way reversing valve 51 is brought about by a pilot valve 52 in response to the above described differential pressure or guide vane position signals as received along line 53.

Operation of the 4-way reversing valve 51 is as follows. During operation at higher load conditions, the reversing valve 51 interconnects line 21 to line 29 and likewise interconnects line 31 to line 35. During lower load operating conditions, the reversing valve 51 interconnects line 21 directly to line 35, while interconnecting lines 29 and 31 to effectively isolate that portion of the system.

While the present invention has been disclosed with particular reference to various particular embodiments, concepts of this invention are readily adaptable to other embodiments, and those skilled in the art may vary the structure thereof without departing from the essential spirit of the present invention.

What is claimed is:

1. An improved oil reclaim system for a centrifugal compressor of the type having a suction housing with an inlet for receiving an oil refrigerant mixture from a cooler and with a cavity for accumulating oil from the mixture, a transmission, and an ejector for pumping accumulated oil from the cavity to the transmission, wherein the improvement comprises;

first valve means fluidly interconnected between the cooler and the inlet;

second valve means fluidly interconnected between the cooler and the ejector;

means for determining when the compressor is operating under low load conditions; and control means for responsively closing the first valve means and opening said second valve means such that the refrigerant oil mixture flows directly from the cooler through the ejector to the transmission.

2. An improved oil reclaim system as set forth in claim 1 and including variable position guide vanes, and further wherein said determining means comprises means for determining the position of the guide vanes.

3. An improved oil reclaim system as set forth in claim 1 wherein said determining means comprises a pressure switch which is responsive to a pressure between the cooler and the suction housing.

4. An improved oil reclaim system as set forth in claim 2 wherein the position of the guide vanes that indicates a low load condition is 30°.

5. An improved oil reclaim system as set forth in claim 3 wherein said determining means is responsive to a pressure differential of 8–10 psia to indicate a load low condition.

6. An improved oil reclaim system as set forth in claim 1 wherein said first valve means comprises a solenoid valve.

7. An improved oil reclaim system as set forth in claim 1 wherein said second valve means comprises a solenoid valve.

8. An improved oil reclaim system as set forth in claim 1 wherein said first and second valve means is combined as a single four way valve.

9. A method of reclaiming oil in a centrifugal compressor of the type having a suction housing with an inlet for receiving an oil/refrigerant mixture from a cooler and with a cavity for accumulating oil from the mixture, a transmission, and an ejector for pumping accumulated oil from the cavity to the transmission, comprising the steps of:

determining when the compressor is operating under low load conditions; and responsively routing a flow of oil/refrigerant mixture flow directly from the cooler, through the ejector to the transmission.

10. An improved oil reclaim process as set forth in claim 9 and including an additional step of responsively preventing the flow of the oil/refrigerant mixture from the cooler to the inlet.

* * * * *